US005082300A

United States Patent [19]

Cucurullo

[11] Patent Number: 5,082,300

[45] Date of Patent: Jan. 21, 1992

[54] ROLLER SKATE

[76] Inventor: Albert J. Cucurullo, 8 Ash Rd., Briarcliff Manor, N.Y. 10510

[21] Appl. No.: 651,537

[22] Filed: Feb. 6, 1991

[51] Int. Cl.[5] ..... A63C 17/06

[52] U.S. Cl. ..... 280/11.22

[58] Field of Search ..... 280/11.22, 11.23, 11.19, 280/11.27, 11.28, 842

[56] References Cited

U.S. PATENT DOCUMENTS 3,649,038 3/1972 Huckenbeck ..... 280/11.19

4,382,605 5/1983 Hegna ..... 280/11.22

FOREIGN PATENT DOCUMENTS 1077586 3/1960 Fed. Rep. of Germany ... 280/11.22

*Primary Examiner*—David M. Mitchell

*Attorney, Agent, or Firm*—Richard L. Miller

[57] ABSTRACT

An improved roller skate is provided and is of the type having a boot and sole plate. The invention includes a first caster carried facing rearwardly in a first swivel hole, a second caster carried facing rearwardly in a first transverse slide opening, a third caster carried facing forwardly in a second transverse slide opening and a fourth caster carried facing forwardly in a second swivel hole on the underside of the sole plate. A pair of tension bars, each having four spaced apart longitudinal slots slideably engaged with the casters. When a skater wants to turn, the boot can be tilted to one side, pushing the casters so as to turn away from the side of the tilt, causing the tension bars to flex and curve outwards thus allowing the skate to turn.

3 Claims, 2 Drawing Sheets

ROLLER SKATE

BACKGROUND OF THE INVENTION

The instant invention relates generally to roller skates and specifically it relates to an improved roller skate.

Numerous roller skates have been provided in the prior art that are adapted to include a plurality of wheels longitudinally positioned therealong. For example, U.S. Pat. Nos. 954,993 to Peters; 2,168,820 to Edstrom and 3,901,520 to McMahan all are illustrative of such prior art. While these units may be suitable for the particular purpose to which they address, they would not be as suitable for the purpose of the present invention as hereafter described.

SUMMARY OF THE INVENTION

A primary object of the present invention is to provide an improved roller skate that will overcome the shortcomings of the prior art devices.

Another object is to provide an improved roller skate that has a narrow wheel base and a turning mechanism similar to that of a bicycle rather than an automobile.

An additional object is to provide an improved roller skate that will possess greater maneuverability and be capable of greater speeds so as to approximate what can be done on an ice skate.

A further object is to provide an improved roller skate that is simple and easy to use.

A still further object is to provide an improved roller skate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims

BRIEF DESCRIPTION OF THE DRAWING FIGURES

The figures in the drawings are briefly described as follows.

DETAILED DESCRIPTION OF THE PREFERRED EMBODIMENTS

Figure 1:
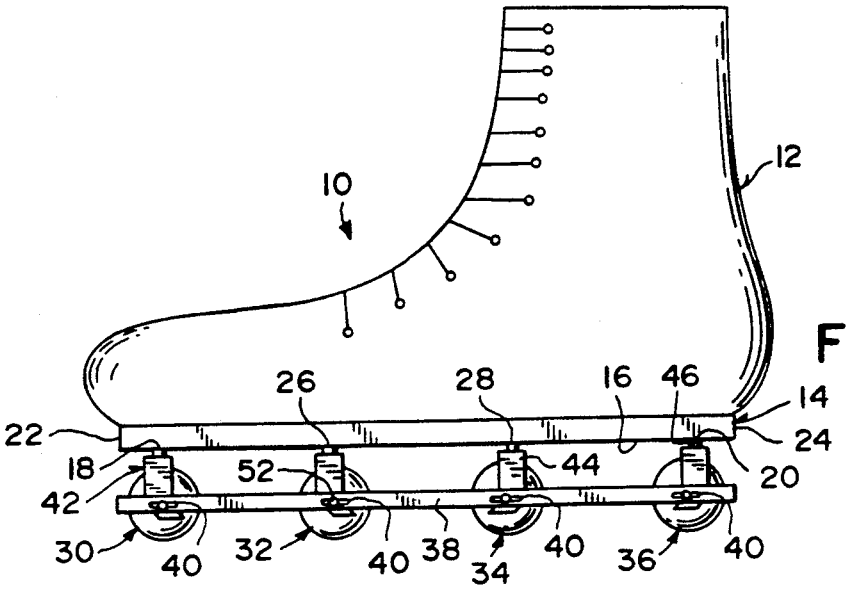
FIG. 1 is a diagrammatic side elevational view of the instant invention per se.
Figure 2:
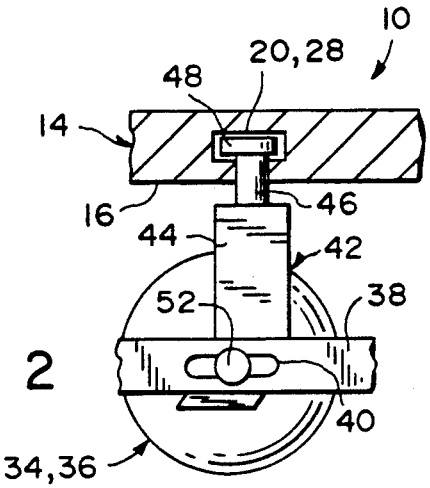
FIG. 2 is a diagrammatic enlarged view shown partially in cross section of either the third or fourth caster and supporting structure therefore, counting from left to right in FIG. 1.
Figure 3:
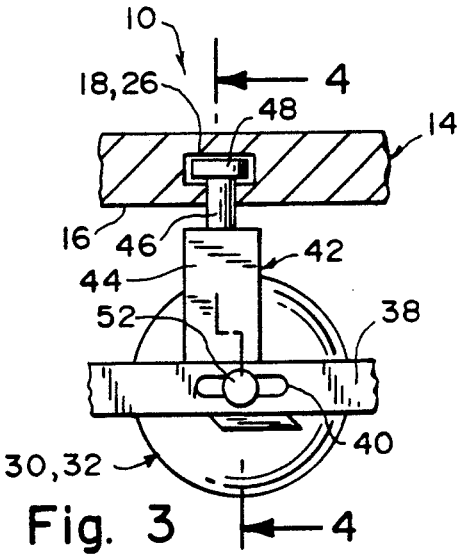
FIG. 3 is a diagrammatic enlarged view shown partially in cross section of either the first or second caster and supporting structure therefore, counting from left to right in FIG. 1.
Figure 4:
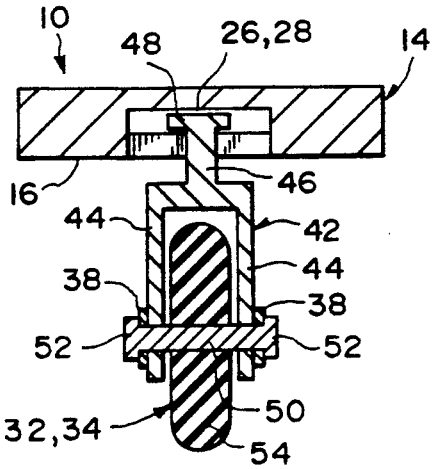
FIG. 4 is a diagrammatic enlarged cross sectional view taken on Line 4—4 of FIG. 3 for either the second or third caster counting, from left to right in FIG. 1.
Figure 5:
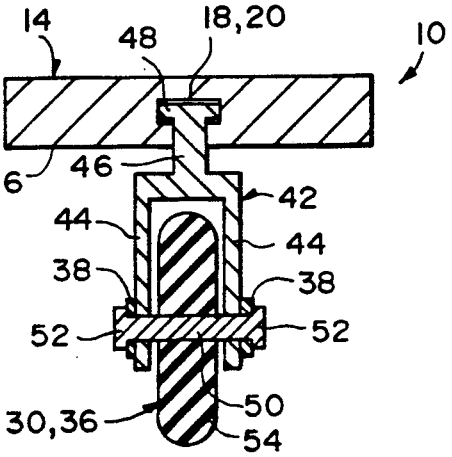
FIG. 5 is a diagrammatic enlarged cross sectional view taken in Line 4—4 of FIG. 3 for either the first or fourth caster counting from left to right in FIG. 1.
Figure 9:
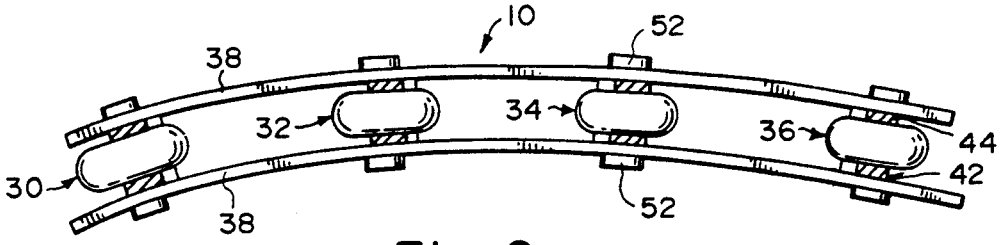
FIG. 9 is a cross sectional view similar to FIG. 8 also taken on Line 8—8 of FIG. 6, but illustrating the invention in a flexed position.
Figure 8:
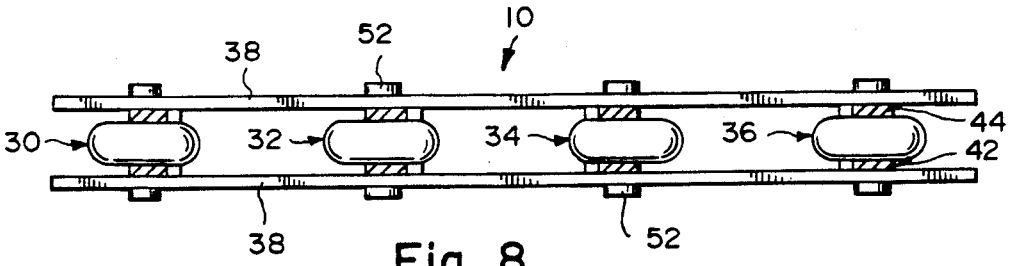
FIG. 8 is a cross sectional view taken on Line 8—8 on FIG. 6.
Figure 6:
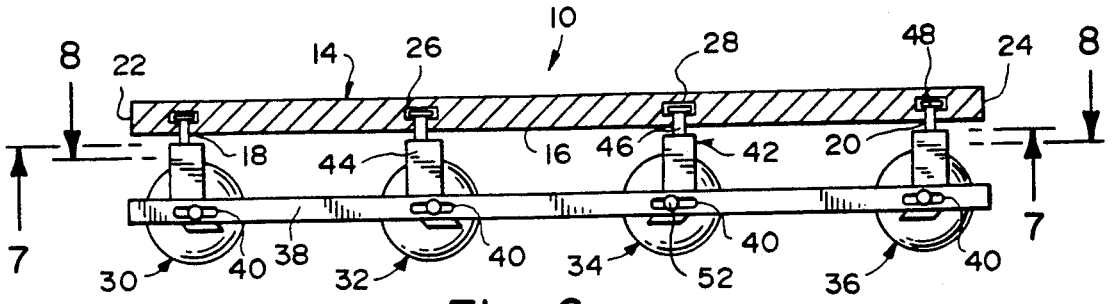
FIG. 6 is a diagrammatic enlarged view partially in section of just the casters and supporting structure therefore shown in FIG. 1.
Figure 7:
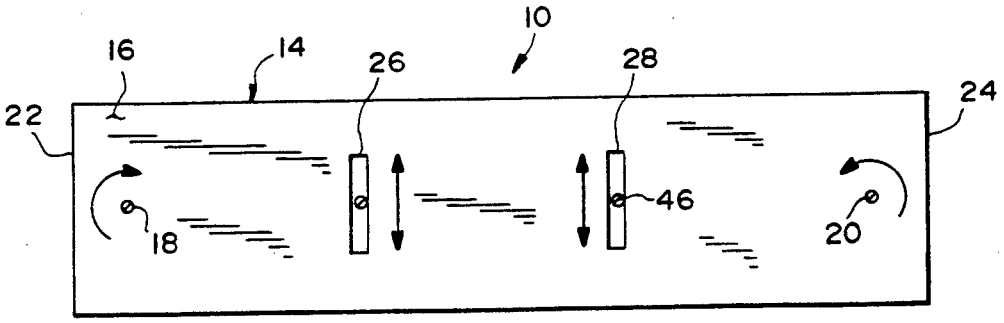
FIG. 7 is a cross sectional view taken on Line 7—7 of FIG. 6.

Turning now descriptively to the drawings, in which like reference characters denote like elements throughout the several views, the Figures illustrate an improved roller skate 10 of the type having a boot 12 and sole plate 14. The instant invention consists of the sole plate 14 having on its underside 16 a pair of swivel holes 18 and 20, in which the first swivel hole 18 is located at the forward end 22 and the second swivel hole 20 is located at the rearward end 24 of the sole plate 14. A pair of transverse slide openings 26 and 28 are equally spaced apart between the swivel holes 18 and 20.

Four casters 30, 32, 34 and 36 are provided. The first caster 30 is carried facing rearward in the first swivel hole 18. The second caster 32 is carried facing rearwardly in the first slide opening 26. The third caster 34 is carried facing forwardly in the second slide opening 28. The fourth caster 36 is carried facing forwardly in the second swivel hole 20.

A pair of tension bars 38 are also provided with each having four equally spaced apart longitudinal slots 40 which slideably engage with the casters 30, 32, 34 and 36, and are linked together in a single file relationship with the tension bars 38 in a parallel position between the casters 30, 32, 34 and 36. When a skater wants to turn, the boot 12 can be tilted to one side, pushing the casters 30, 32, 34 and 36 so as to turn away from the side of the tilt, causing the tension bars 38 to flex and curve outwards thus allowing the skate 10 to turn.

Each caster 30, 32, 34 and 36 includes a yoke 42 having a pair of downwardly extending arms 44. A shaft 46 extends upwardly from the yoke 42 and has an enlarged top portion 48 that can rotate within any of the swivel holes 18 and 20 and the slide openings 26 and 28. An axle 50 extends through the arms 44 of the yoke 42 and has a pair of enlarged heads 52. Each head 52 is located on an opposite end of the axle 50 so as to slide longitudinally in respective longitudinal slots 40 in one tension bar 38. A wheel 54 is rotatively carried on the axle 50 between the arms 44 of the yoke 42.

Each tension bar 38 is fabricated typically out of a strip of durable flexible metal material having a spring like characteristic. Each yoke 42 and axle 50 is preferably fabricated typically out of a durable metal material while the wheel 54 is preferably made out of a hard rubber, plastic or the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved roller skate of the type having a boot and a sole plate, wherein the improvement comprises:

a) a sole plate having on its underside a pair of swivel holes, in which said first swivel hole is located at the forward end and said second swivel hole is located at the rearward end of the sole plate and a pair of transverse slide openings equally spaced apart between said swivel holes;

b) four casters in which said first caster is carried facing rearwardly in said first swivel hole, said second caster is carried facing rearwardly in said first slide opening, said third caster is carried facing forwardly in said second slide opening and said fourth caster is carried facing forwardly in said second swivel hole; and c) a pair of tension bars, each having four spaced apart longitudinal slots slideably engageable with said casters and are linked together in a single file relationship with said tension bars in a parallel position between said casters so that when a skater wants to turn, the boot can be tilted to one side, pushing said casters so as to turn away from the side of the tile, causing said tension bars to flex and curve outwards thus allowing said skate to turn.

2. An improved roller skate as recited in claim 1, wherein each said caster includes:

a) a yoke having a pair of downwardly extending arms;

b) a shaft extending upwardly from said yoke, said shaft having an enlarged top portion that can rotate within any of said swivel holes and said slide openings;

c) an axle extending through the arms of said yoke and having a pair of enlarged heads, each said head located on an opposite end of said axle so as to slide longitudinally in a respective longitudinal slot in one said tension bar; and d) a wheel rotatively carried on said axle between the arms of said yoke.

3. An improved roller skate as recited in claim 2, wherein each said tension bar is fabricated out of strip of durable flexible metal material having a spring like characteristic.

* * * * *